United States Patent [19]

Thayer

[11] Patent Number: 5,054,248

[45] Date of Patent: Oct. 8, 1991

[54] FOUR-WAY HAND SANDER

[76] Inventor: Donald R. Thayer, 2309 S. 900 E, Lafayette, Ind. 47905

[21] Appl. No.: 375,374

[22] Filed: Sep. 3, 1989

[51] Int. Cl.[5] ..... B24D 15/04

[52] U.S. Cl. ..... 51/392; 51/407; 51/358

[58] Field of Search ..... 51/391-393, 51/406, 407, 205 R, 211 R, DIG. 14, 358

[56] References Cited

U.S. PATENT DOCUMENTS

| | | | |
|---|---|---|---|
| 2,112,593 | 3/1938 | Campbell | 51/392 |
| 2,411,615 | 11/1946 | Dodelin | 51/391 |
| 2,650,158 | 8/1953 | Eastman | 51/407 |
| 2,670,579 | 3/1954 | Applegate | 51/392 |
| 3,998,012 | 12/1976 | Ness | 51/391 |
| 4,263,755 | 4/1981 | Globus | 51/406 |

FOREIGN PATENT DOCUMENTS

| | | | |
|---|---|---|---|
| 0103560 | 3/1984 | European Pat. Off. | 51/211 R |
| 1703721 | 12/1971 | Fed. Rep. of Germany | 51/392 |

*Primary Examiner*—Robert A. Rose

*Attorney, Agent, or Firm*—Woodard, Emhardt, Naughton, Moriarty & McNett

[57] ABSTRACT

A hand-held sander includes a body formed of a flexible cellular polyester polurethane foam, molded in place with a working surface of either plastic coated fabric (for use with adhesive-backed abrasives) or the 'hook' portion of a "hook and loop" type gripping system, for holding woven or non-woven materials in place. The body includes a handle, leading ends extending from the handle of differing lengths, thicknesses and rates of flexural resistance. One leading end includes a radius edge while the other leading end forms an acute angle edge. These design features permit a broad range of forces to be exerted upon the work by the user via its working surface, in the preparation and/or finishing of the surface(s) of many materials; the adaptability of its working surface to a wide range of surface configurations and compound radii; improved accessibility to confined or restricted areas; the exertion and spread (or conatainment) of a range of localized pressure forces by digital (thumb and/or fingertip(s')) control; a stabilized zone for flat sanding; and, finally a means for applying a blend of forces along an extended path of differing, yet parallel, work planes.

13 Claims, 2 Drawing Sheets

FOUR-WAY HAND SANDER

BACKGROUND OF THE INVENTION

The instant invention concerns a hand-held and hand-operated implement used in conjunction with sandpaper and/or other surface conditioning products or materials for the purposes of removing rust, paint and other surface 'objectionables'; and for smoothing, 'feathering' or otherwise preparing, polishing or finishing surfaces of a broad range of contours and materials such as metal, wood, welding/brazing and glue joints, fiberglass, plastics, composition, painted and any other type of surface or surface material.

SUMMARY OF THE INVENTION

The invention comprises hand-held sander formed by a body of flexible elastomeric material. The basic material of the 'hand sander' body may be any of several cellular or non-cellular elastomeric materials, either solid, foamed or molded-in-place, or rotationally cast with gaseous or air space in center.

The working surface of the hand sander may be the basic material from which the body itself is made, or it may consist of any one of several materials bonded to the body either in the molding process or afterward by gluing or by some other laminating process as may afford the physical properties of flexure, stress and strain appropriate to its intended use.

The selection of material which may be bonded to and, thereby, become the primary working surface, itself, may consist of but is not necessarily limited to vinyl or other 'plastic-coated fabrics' and/or any of a number of other flexible or fabric-based materials designed to hold other materials in place by mechanical attachment, adhesion (i.e., cement, or as with 'pressure-sensitive adhesive'), vacuum, friction and/or surface tension.

The body includes a handle which transitions to opposite leading ends and lateral sides. One of the leading ends has a long transition portion to a thin edge so that the end can flex along the transition portion. The transition portion forms an acute angle at the thin edge to provide further area for the working surface. The other leading end has a relatively shorter and thicker transition portion to a thick edge. The body further includes opposite sides, one side being thicker than the other.

One object of the invention is to provide a hand-held sander having expanded versatility over prior devices. In particular, the present invention combines several sanding or finishing elements in a single body to permit use of the hand sander in a variety of applications.

DESCRIPTION OF THE PREFERRED EMBODIMENT

Figure 2:
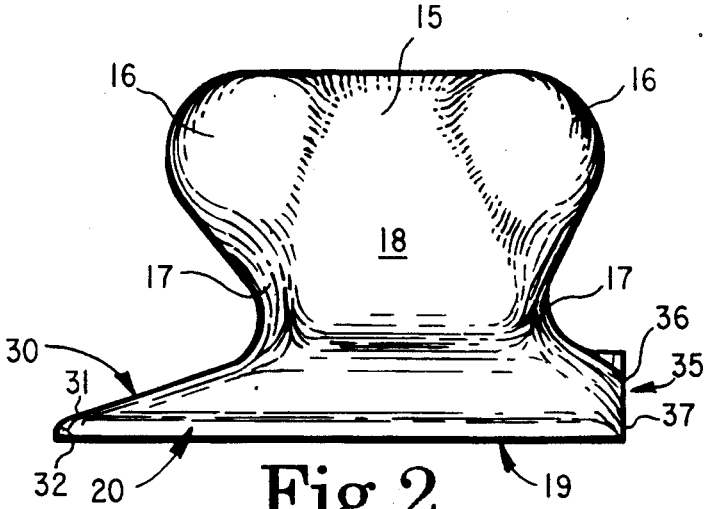
FIG. 2 is an end elevational view of the sander of FIG. 1, taken along line 2—2 as viewed in the direction of the arrows.
Figure 1:
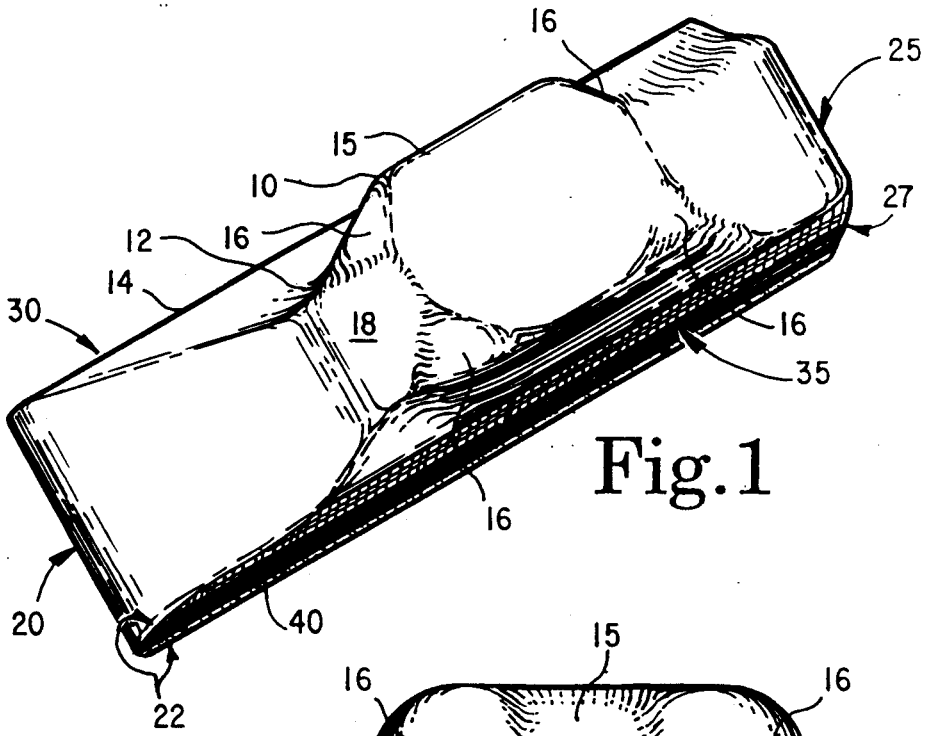
FIG. 1 is a top elevational orthographic view of one embodiment of the hand-held sander of the present invention.
Figure 3:
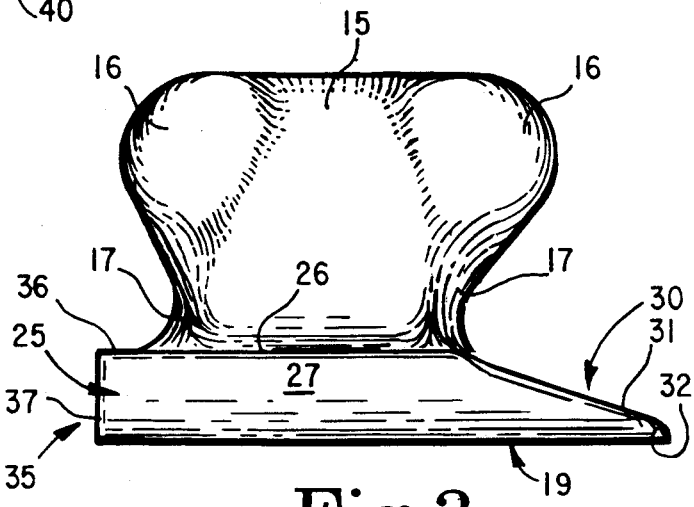
FIG. 3 is an end elevational view of the sander of FIG. 1, taken along line 3—3 as viewed in the direction of the arrows.
Figure 4:
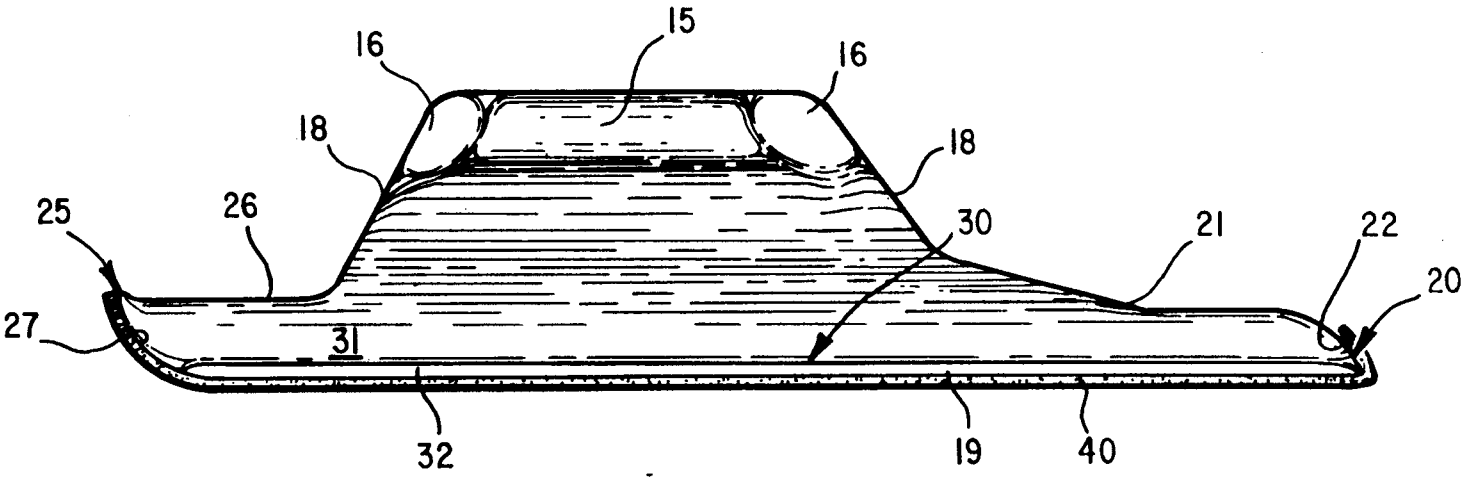
FIG. 4 is a side elevational view of the sander of FIG. 1 taken along line 4—4 as viewed in the direction of the arrows, and showing one embodiment of the working surface of the hand-held sander of the present invention.

The hand-held sander 10 of this invention is shown in FIG. 1 and consists of a body 12 and a working surface 40. The body 12 of the hand sander 10 includes a handle 15 formed on a top face 14 of the body 12, and is bounded by leading ends 20 and 25 and sides 30 and 35.

The material used for the body 12 may be either cellular or non-cellular and is of an elastomeric nature; either polyether or polyester urethane (self-skinning or non self-skinning) rubber, vinyl, polyethylene or another type of plastic thermosetting material. Of the non-cellular types, construction may be solid or of a rotocast, vented, hollow, gas or air-filled thermoset elastomer. In the preferred embodiment, the body 12 is composed of a cellualr polyester urethane material. The physical properties of the open celled polyester urethane material used in the construction of this invention, specifically those of hardness (durometer), resilience, elongation, cell size and tensile strength, are all properties which may be regulated and/or altered either by chemical formulation or by control of density and mass, or both. These physical properties govern the ability of the hand sander 10 to adapt to use in a wide variety of applications, as determined by the levels and breadth of working pressures required and the contour of the surface to be sanded or finished.

The working surface 40 is associated with the bottom face 19 of the body 12 and extends onto the leading ends 20 and 25. The material used for this surface 40 may, in the cases of non-cellular solid, self skinning or rotocast body 12, consist of the principal material from which the body, itself, is made. The working surface 40 may also constitute another material bonded to the bottom face 19, either mechanically and/or physically during the foaming, thermosetting or rotocasting portion of the process, or by means of lamination using an appropriate adhesive or other bonding agent.

The cellular polyurethane body 12 if not made of self skinning urethane, will be essentially of uniform mass throughout, and the surface of "facing material" to be used as the working surface 40 is bonded in place during the foaming operation; that is, the foaming of the unit in its mold. The facing material then becomes an integral part of the body 12 of the hand sander 10.

The facing material comprising the working surface 40 may be any material that is properly suited to such incorporation by the bonding methods described, and as shall properly and effectively serve to accommodate the finishing materials for which it is and with which it is to be used.

In one preferred embodiment, the working surface 40 may be one or more of several types of plastic-coated fabrics for use in applications employing paper-backed abrasives bonded to the working surface by disc adhesive or papers employing pressure sensitive adhesive, or other abrasive and finishing polishes or compounds. In another embodiment, any one or more of several types of fabric and/or mechanical 'hook' type materials, as employed in various 'hook and loop' mechanical attachment systems for use as the gripping surface for a variety of surface preparation and finishing products having attaching surfaces adapted to one or more of such 'hook' or 'mushroom' style interlocking surface devices, may be used.

The handle 15 of the hand sander 10 is designed to afford comfort, a secure grip and versatility to the user.

It allows the user to employ either end 20 or 25, as the leading end of the hand sander, depending upon the nature, configuration and/or clearance of the surface being sanded, polished or prepared for finish. It also permits the user to exert varying levels and breadths of pressure, as the work requires, either to the leading end, as determined by the user, by applying pressure with one or more digits of the hand, or laterally via the thumb or, again one or more finger tips, as needed.

The sloping portion 18 of the handle 15 also permits the application of pressure uniformly across the working surface of the leading ends or laterally, originating from the user's grip of the handle itself at finger recesses 17, and as determined by the attitude and pitch of the flat portion of the working surface 40 of the hand sander. The pressure thus applied and the resulting forces may be varied in direction and intensity by combination of pressure exerted by the user and the ascending or declining design resistance associated with and resulting from the combined physical properties and graduation of body thickness leading from the handle 15 to the ends 20 and 25 and sides 30 and 35. This unique feature is especially valuable for blending ("feathering") paint finishes consisting of several layers from top layer to base coat and for tapering other materials in a repair process.

The handle 15 is modified or contoured at each corner 16 to eliminate potential pressure points which would otherwise result in discomfort to the user when used over extended periods of time.

In addition, the "bulk" of the material of the handle 15 of the solid (cellular) version affords the user a specific area of working surface 40 situated directly beneath the mass of the handle 15 which remains flat for those applications where a flat sanding surface is essential.

The protracted end 20 of the hand sander 10 as noted above, affords the user the option of variable and 'localized' (fingertip) pressure. A second attribute to this extension is the comfort and protection against compression discomfort or blistering provided by the cushioning and flexure of the cellular elastomeric plastic foam construction of the preferred embodiment. Additional advantages of this aspect of the design are its "French Curve" adaptabilities to concave surfaces of indistinct radii, as well as its similar versatility with convoluted and convex surfaces due to the extended length of the forward portion 21. This forward portion 21 can bend or flex to conform to various surface contours, in part due to the geometry of the portion and in part due to the material of the body 12. Another benefit of this facet of the hand sander 10 is the ability to extend its flexible sanding, abrading or polishing capability to confined areas beyond the point of accessibility of other flexible 'soft hand pads' or by hand, alone. The acute angled edge 22 peculiar to the tip of this leading end 20 permits the abrasive, cloth or other material being used to be folded at that angle over the angled edge 22 thus providing a tight "V" configuration for cleaning or access to very finite spaces. The forward portion 21 extends he working surface at the angled edge 22 away from the handle 15 to allow user access to confined sanding areas.

The other leading end 25 with radius edge 27 offers similar 'French Curve' versatility to that of the leading end 20. The greater thickness of cross-section and shorter length of the transition portion 26, however, impart the capability to exert a much greater force upon the work. Further, the curved radius edge 27 permits the user to address much tighter radii of surfaces being prepared or finished and to work more aggressively on larger radii.

The first side 30 of the body 12 provides a finger-tip or thumb-tip managed edge of the hand sander 10 for blending forces from the heavier cross-section of the handle 15 through the transition portion 31 to a thin edge 32, again affording protection and comfort to the user and a much more sensitive digital control of the force being exerted upon the work surface. It also permits a much more localized control of the force being applied by the user.

This blended lineal edge 32 also allows the uniform sanding/preparation of radii and curved surfaces which extend for greater continuous lengths. The thin edge 32, as it joins the extension of the leading angled edge 22, imparts to the hand sander 10 a maximum variability and versatility to the 'art' of "feathering" and fine finishing.

The opposite side 35 has a thicker edge 37 which permits the hand sander 10 to be used to remove the finish or surface linearly along one side of a 'V' pattern. The thickness of edge 37 as well as the short transition portion 36 from the handle 15 also allows the user to employ greater and more uniform force along a given path.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The novelties claimed by the petitioner as being those wholly conceived by him and which constitute the essence of this invention are as follows:

1. A hand-held sanding tool comprising:

a body composed of a resilient flexible material, said body having a top face, a bottom face, a first end, an opposite second end, a first side and an opposite second side, wherein said top face defines a handle thereon adapted to be grasped by a user;

said first end includes a first transition portion extending from said handle to a first edge, said first transition portion being relatively more flexible than said handle to permit flexing of said first transition portion when pressure is applied at said first end;

said second end includes a second transition portion extending opposite said first transition portion from said handle to a second edge, said second transition portion being relatively shorter and thicker than said first transition portion so that said second transition portion is relatively rigid when pressure is applied at said second end; and a working surface associated with said bottom face and extending at least from said first edge to said second edge.

2. The tool of claim 1, wherein said working surface is integrally formed with said body to form surface finishing features.

3. The tool of claim 1, wherein said working surface includes means for attaching a surface finishing facing material.

4. The tool of claim 1, wherein:
said first edge defines an acute angle between said bottom face and said first transition portion; and
said working surface extends around said first edge onto said first transition portion.

5. The tool of claim 1, wherein:
said second edge defines an radius between said bottom face and said second transition portion; and
said working surface extends around said second edge onto said second transition portion.

6. The tool of claim 1, wherein:
said first side tapers from said handle to a first side edge, said first side being relatively more flexible than said handle to permit flexing of said first side when pressure is applied at said first side edge; and
said working surface extends to said first side edge.

7. The tool of claim 1, wherein:
said second side has a generally uniform thickness from said handle to a second side edge, the thickness of said second being approximately equal to the thickness of said second transition portion so that said second side is relatively rigid when pressure is applied at said second side edge; and
said working surface extends to said second side edge.

8. The tool of claim 6, wherein:
said second side has a generally uniform thickness from said handle to a second side edge, the thickness of said second being approximately equal to the thickness of said second transition portion so that said second side is relatively rigid when pressure is applied at said second side edge; and
said working surface extends to said second side edge.

9. The tool of claim 7, wherein said second side edge forms a right angle to said bottom face.

10. The tool of claim 1, wherein said handle includes:
a generally flat rectangular top face blending to said first and second transition portions; and
recesses beneath said rectangular top face for finger access by the user.

11. The tool of claim 10, wherein each of the corners of said rectangular top face is beveled.

12. A hand-held sanding tool comprising:
a body composed of a resilient flexible material, said body having a top face, a bottom face, a first end, an opposite second end, a first side and an opposite second side, wherein
said top face defines a handle thereon adapted to be grasped by a user;
said first end includes a first transition portion extending from said handle to a first edge;
said second end includes a second transition portion extending from said handle to a second edge,
said first transition portion being relatively more flexible than said second transition portion so that said first end is permitted to flex relatively more than pressure is applied at said first end; and
a working surface associated with said bottom face and extending at least from said first edge to said second edge.

13. A hand-held sanding tool comprising:
a generally rectangular body composed of a resilient flexible material, having a longitudinal length greater than its lateral width, said body including:
a top face;
an opposite bottom face;
opposing longitudinal ends;
a handle integral with said top face and adapted to be grasped by a user;
a first lateral side extending from said handle;
an opposite second lateral side extending from said handle;
wherein said body is thicker at said second lateral side than at said first lateral side; and
further wherein said body is adapted to flex along the longitudinal length of said body at said first side.

* * * * *